United States Patent [19]

Ikeda et al.

[11] 4,401,717

[45] Aug. 30, 1983

[54] HEAT-SENSITIVE RECORDING MATERIAL

[75] Inventors: Teppei Ikeda; Sadao Ishige; Nobuyoshi Sekikawa, all of Ashigara; Akira Igarashi; Takekatsu Sugiyama, both of Fujinomiya, all of Japan

[73] Assignee: Fuji Photo Film Co., Ltd., Kanagawa, Japan

[21] Appl. No.: 324,167

[22] Filed: Nov. 23, 1981

[30] Foreign Application Priority Data

Nov. 21, 1980 [JP] Japan ..... 55-164385

[51] Int. Cl.[3] ..... B41M 5/18

[52] U.S. Cl. ..... 428/425.1; 282/27.5; 427/150; 427/151; 428/320.8; 428/411; 428/488; 428/537; 428/913

[58] Field of Search ..... 427/150, 151, 152; 428/913, 488, 320.4, 320.6, 320.8, 411, 425, 537, 914; 282/27.5

[56] References Cited

U.S. PATENT DOCUMENTS 4,243,716 1/1981 Kosaka et al. ..... 282/27.5

FOREIGN PATENT DOCUMENTS 33989 4/1981 Japan ..... 282/27.5

*Primary Examiner*—Bruce H. Hess

*Attorney, Agent, or Firm*—Sughrue, Mion, Zinn, Macpeak & Seas

[57] ABSTRACT

A heat-sensitive recording material comprising a base and one or more heat-sensitive color-forming layers containing an electron donating colorless dye and an electron accepting organic compound is disclosed, wherein at least one of said color-forming layers contains a urea derivative having a least 7 carbon atoms or a urethane derivative having at least 8 carbon atoms.

2 Claims, 5 Drawing Figures

HEAT-SENSITIVE RECORDING MATERIAL

FIELD OF THE INVENTION

The present invention relates to a heat-sensitive recording material, and, more particularly, to one using a color forming reaction between an electron donating colorless dye and an electron accepting organic compound.

BACKGROUND OF THE INVENTION

Heat-sensitive recording materials produce a recorded image by using the physical or chemical change of a substance due to thermal energy, and many thermographic processes have been studied. "Wax type" heat-sensitive recording sheets that use the physical change of a substance due to thermal energy have been known for many years, and are used, e.g., in electrocardiograms. A number of heat-sensitive recording sheets that depend on various color forming mechanisms using the chemical change of a substance due to thermal energy have been proposed, and "two-color forming component" heat-sensitive recording sheets are typical of this type of sheet.

To make a two-color forming component heat-sensitive recording sheet, typically a dispersion of fine particles of two thermal reactive compounds is mixed with binder particles to form a coating solution, which is applied to a base in such a manner that the two thermal reactive compounds remain separated from each other by the binder particles. This sheet forms an image by using a color forming reaction that is initiated upon contact between the two compounds when one or both compounds are melted with heat. The two compounds are generally referred to as an electron donating compound and an electron accepting compound, respectively. While there are many combinations of these compounds, they generally consist of those which form an image of metallic compounds, and those which form a dye image. Examples of the combinations that form a dye image typically use electron donating colorless dyes as the electron donating compound and phenols and other acidic substances as the electron accepting organic compound (Japanese Patent Publication Nos. 4160/68 and 3680/69).

These two-color forming component heat-sensitive recording sheets have advantages for use as a heat-sensitive recording sheet, e.g., (1) they depend on a primary color forming reaction, and require no developing step, (2) the texture of the sheet is similar to that of ordinary paper, and (3) they are easy to handle. The sheets using colorless dyes as the electron donating compound have greater commercial value in that they achieve not only the three advantages described above but also the following two additional merits: (4) they provide a higher color density, and (5) heat-sensitive recording sheets providing various colors can be easily prepared. In view of these advantages, the latter type of sheets are used most frequently as heat-sensitive recording materials, e.g., for image recording sheets for facsimiles. The heat-sensitive recording materials of dye image forming type are also used in an increasing volume as data recording means to be incorporated in laboratory equipment, medical equipment, and industrial measuring instruments.

The most common heat-sensitive recording material that is used currently is a heat-sensitive recording paper having a paper base. Paper is used as the base material for various reasons—low price, stiffness, and compatibility with writing devices. Therefore, the following description of the process and features of the present invention is directed to the most commonly used heat-sensitive recording paper, but it should be understood that the present invention is by no means limited to this particular type of heat-sensitive recording material.

As was already mentioned, the heat-sensitive recording paper is used for recording facsimile and other forms of information. To be used in many applications, heat-sensitive recording papers having various thermographic characteristics must be developed. For two- or three-color formation, a recording material comprising a plurality of layers that produce different colors (e.g., a two-layer arrangement wherein the upper layer contains a color former that forms a blue color at lower temperatures and the lower layer contains a color former that forms a red color at higher temperatures) is scanned with a hot pen at different temperatures. In this color forming process, the respective layers must have different thermal sensitivities for color formation. For recording in facsimiles, several types of recording paper that have mode-adapted sensitivities are necessary, since the recording speed varies with the operation mode.

One example of the heat-sensitive recording paper is a paper base coated with a dispersion of an electron donating colorless dye (hereunder referred to as a color former) and an electron accepting organic compound (hereunder referred to as a color developer) in a binder made of a water-soluble polymer. When the paper is heated, the color developer or color former is melted and spread through the heat-sensitive color-forming layer to contact the color former or color developer to cause a color forming reaction and provide a desired recorded image. The temperature dependency of the sensitivity and image density of the heat-sensitive recording paper varies with the temperature at which the color developer (or color former) is melted and their color forming properties. The characteristic curves for three heat-sensitive recording systems are depicted in FIG. 1 wherein curve A shows the highest heat-sensitivity. The recording systems having curves B and C exhibit different behaviors at about 200° C. which is the operating temperature of the heating element. The system having curve A provides gradation over a wide range of color-forming temperatures, and is adapted to record an image requiring a wide gradation in density. On the other hand, a multi-layer heat-sensitive recording paper using heat-sensitive color-forming layers having two curves, say, curves A and B, can be used to record information in the form of a two-color image.

In the production of a heat-sensitive recording paper, it has been found that a color can be formed at a desired temperature between ordinary temperatures (i.e., 20° C. to 30° C.) and the melting point of the developer by incorporating in the heat-sensitive color-forming layer (1) fine particles of eutectic mixture crystals prepared by melting an electron accepting organic compound (color developer) with one or more organic compounds that change its melting point, or (2) fine particles of a mix of the eutectic mixture crystals of color developer and melting point modifier and the crystals of the respective components, or (3) fine particles of a solid solution of the developer and melting point modifier, or the combination of a core made of one component crystal (e.g., fine crystal of color developer) and a skin made of non-crystalline or partially crystalline form of the other component (e.g., melting point modifier), for example, as described in Japanese patent application No. 110942/80, or (4) fine particles obtained by grinding a non-crystalline solid cooled from a melt of the developer and melting point modifier (the melt may crystalize if the melt is maintained for a long period of time). In short, by using these fine particles, heat-sensitive recording papers capable of changing image density over a wide range of developing temperatures (those papers capable of providing a wide gradation) can be designed.

Amides of long-chain aliphatic carboxylic acids and primary amines are known as substanes that can be used with the electron accepting organic compound (color developer) to change its melting point; see Japanese patent application (OPI) No. 48751/78 (the term OPI as used herein means an unexamined published Japanese patent application). However, such amides can vary the melting point of the color developer only over a very small range, and this is particularly so if they are contained in fine particles of organic compounds having a phenolic hydroxyl group, aromatic or aliphatic organic carboxylic acids, salicylic acid and salicylic acid derivatives as described in Japanese patent application (OPI) No. 48751/78. Among the compounds mentioned in Japanese patent application (OPI) No. 48751/78, stearic acid amide, oleic acid amide, palmitic acid amide, and lauric acid amide can hardly change the melting point of the developers as described above.

SUMMARY OF THE INVENTION

Therefore, an object of the present invention is to provide a heat-sensitive recording material that has quick response to various pulse durations produced by the recording head to provide adequate color density with high heat efficiency, and which also achieves a wide range of color density depending upon the operating temperature of the recording head.

This object of the present invention can be achieved by a heat-sensitive recording material comprising a base and one or more heat-sensitive color-forming layers containing an electron donating colorless dye and an electron accepting organic compound, wherein at least one of said color-forming layers contains a urea derivative having at least 7 carbon atoms or a urethane derivative having at least 8 carbon atoms. The present invention is characterized by the urea or urethane derivative that is contained in the heat-sensitive recording layer made of a particular combination of color former and color developer (usually selected to achieve the best compromise between thermal sensitivity and economy), and by this feature, the invention enables not only the thermal sensitivity of the recording layer but also the color gradation to be adjusted to desired levels.

BRIEF DESCRIPTION OF THE DRAWINGS

The accompanying figures depict the relation between the operating temperature of a heating element and the image density obtained by using the heat-sensitive recording material of the present invention. The developing temperature noted in FIGS. 2 to 5 is the temperature of the heating head of a flat plate impression test developer.

DETAILED DESCRIPTION OF THE INVENTION

Figure 1:
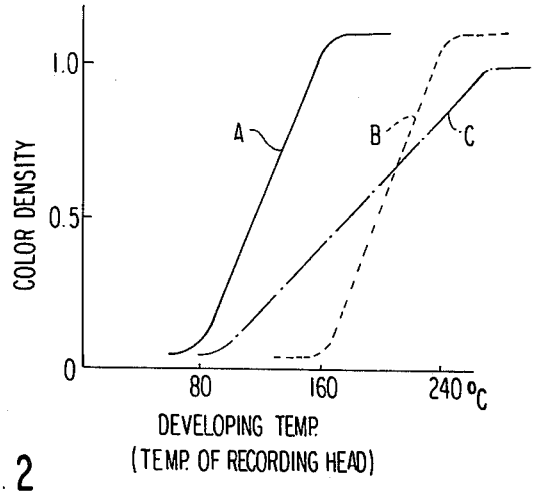

The urea derivative having at least 7 carbon atoms that can be used according to the invention preferably has the formula (I)

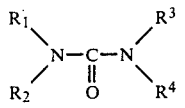

(I)

wherein $R^1$, $R^2$, $R^3$, and $R^4$ (which may be the same or different) each represents a hydrogen atom, or a substituted or unsubstituted alkyl or aryl group; $R^4$ may also represent the group of formula (Ia)

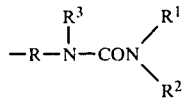

(Ia)

wherein R is an alkylene, allylene, aralkylene, or oxyalkylene group; and $R^1$, $R^2$ and $R^3$ have the same meaning as defined above; and the sum of the carbon atoms of the substituents represented by $R^1$, $R^2$, $R^3$, and $R^4$ in the formula (I) is at least 6. The alkyl group represented by $R^1$, $R^2$, $R^3$, and $R^4$ in the formula (I) preferably has from 1 to 18 carbon atoms, and preferred substituted alkyl groups are alkoxy-substituted alkyl groups having a total of from 3 to 12 carbon atoms, or aryloxy-substituted alkyl groups having a total of 7 to 21 carbon atoms. The aryl group may be substituted, and preferably has from 6 to 28 carbon atoms.

The urethane derivative used according to the invention preferably has the formula (II), (III), or (IV)

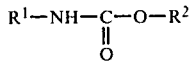

(II)

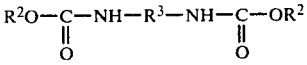

(III)

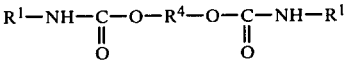

(IV)

wherein $R^1$ is a substituted or unsubstituted alkyl group or aryl group; $R^2$ is a substituted or unsubstituted alkyl group; $R^3$ is an alkylene, allylene, aralkylene, or oxyalkylene group; and $R^4$ is an alkylene or oxyalkylene group. In the formulae (II), (III), and (IV), the alkyl group represented by $R^1$ and $R^2$ preferably has from 1 to 18 carbon atoms, and the substituted alkyl group is preferably an aryl-, alkoxy- or aryloxy-substituted alkyl group having from 7 to 21 carbon atoms, and the aryl group represented by R preferably has from 6 to 28 carbon atoms.

Specific examples of urea derivatives having the formula (I) are listed below: 1-phenylurea, 1-methyl-3-phenylurea, 1-ethyl-3-phenylurea, 1,1-diethyl-3-phenylurea, 1-phenyl-3-propylurea, 3-phenyl-1,1-dipropylurea, 1-isopropyl-3-phenylurea, 1-isopropyl-3-phenyl-1-propylurea, 1,1-diisopropyl-3-phenylurea, 1-butyl-3-phenylurea, 1,1-dibutyl-3-phenylurea, 1-isobutyl-3-phenylurea, 1-tertiarybutyl-3-phenylurea, 1-tertiarybutyl-1-methyl-3-phenylurea, 1-pentyl-3-phenylurea, 1,1-dipentyl-3-phenylurea, 1-tertiary-pentyl-3-phenylurea, 1-isopentyl-3-phenylurea, 1-phenyl-3-(1,2,2-trimethylpropyl)urea, 1-(1-ethyl-3-methylbutyl)-3-phenylurea, 1-(1-ethyl-2,2-dimethylbutyl)-3-phenylurea, 1-phenyl-3-(1,1,3,3-tetramethylbutyl)urea, 1-decyl-3-phenylurea, 1-(1-butylhexyl)-3-phenylurea, 1-(1-butyl-1-ethylpentyl)-3-phenylurea, 1-dodecyl-3-phenylurea, 1-octadecyl-3-phenylurea, 1-cyclohexyl-3-phenylurea, 1,1-dicyclohexyl-5-phenylurea, 1-(3-methoxy-propyl)-3-phenylurea, 1-(3-cyclohexyl-propyl)-3-phenylurea, 1-(p-methoxyphenyl)-3-butylureide, 1-(2-phenoxyethyl)-3-phenylurea, 1-benzyl-3-phenylurea, 1-(4-octadecyloxyphenyl)-3-phenylurea, 1-octadecylurea, 1-dodecyl-3-butylurea, 1-benzyl-3-butylurea, 1,1-diisobutyl-3-(1-naphthyl)urea, 1,3-dioctadecylurea, 1,1-dimethyl-3-(2,4-xylyl)urea, 4,4'-bis(3-butylureido)diphenylmethane, 2,2-bis[3-(2-butoxyethyl-)ureido]toluene, and 1,6-bis(3-benzylureido)hexane.

Specific examples of urethane derivatives having the formulae (II), (III) and (IV) are listed below: phenylcarbamoyloxydodecane, phenylcarbamoyloxyoctadecane, phenylcarbamoyloxymethylbenzene, octadecylcarbamoyloxymethylbenzene, 5-methyl-1-(phenylcarbamoyloxy)hexane, 1,4-bis(phenylcarbamoyloxymethyl)benzene, bis(2-phenylcarbamoyloxyethyl)ether, 1,3-bis(phenylcarbamoyloxy)propane, 1-phenoxy-5-(phenylcarbamoyloxy)pentane, 1,6-bis(phenylcarbamoyloxy)heptane, 1,2-bis(phenylcarbamoyloxy)cyclohexane, 4,4'-bis(ethoxycarbonylamino)diphenylmethane, 4,4'-bis(isopropoxycarbonylamino)diphenylmethane, 4,4'-bis(benzyloxycarbonylamino)diphenylmethane, 4,4'-bis(dodecyloxycarbonylamino)diphenylmethane, 2,4-bis(dodecyloxycarbonylamino)toluene, 1-(2-phenoxyethoxycarbonylamino)naphthalene, 1,5-bis(2-butoxyethoxycarbonylamino)naphthalene, 1,4-bis(ethoxycarbonylaminomethyl)benzene, 1,6-bis(hexadecyloxycarbonylamino)heptane, and 3,3'-bis(octadecyloxycarbonylamino)dipropyl ether.

A heat-sensitive recording material using these urea or urethane derivatives independently (singly) provides a color density that changes with the developing temperature with a larger gradient than when these derivatives are used in combination. Thus difference of the gradient is believed to be due to that when the these derivatives are used in combination, a melting point of the mixture of these derivatives becomes broad ranges and thereby the more sharp increase of the color-forming temperature with the developing temperature cannot be obtained. However, if required, e.g., when the color developer or color former is not sufficiently dissolved using a singly a melt of urea or urethane derivative, two or more of these urea or urethane derivatives may be used together, and they may even be used in combination with a known heat fusible material. The amount of these urea or urethane derivatives used in the present invention is about 10 to 300% by weight, preferably 50 to 150% by weight, based on the color developer. These additives can be incorporated in the heat-sensitive recording layer by various methods. Some of these additives (i.e., urea derivatives, urethane derivatives, mixtures thereof, or with other heat fusible materials) from an eutectic mixture with an electron accepting organic compound that has a lower melting point than the organic compound. Therefore, a heat-sensitive recording paper having high sensitivity can be produced by incorporating in the heat-sensitive recording layer fine particles prepared by solidifying and crystallizing an eutectic mixture of the electron accepting organic compound and the above named additives, since the resulting eutectic mixture melts at a temperature lower then the melting point of the organic compound. However, it has been found according to this invention, as will be apparent from the description of the Examples, that a developer mixture (i.e., a mixture of the electron accepting organic compound and an additive that changes its melting point) can be prepared by adding fine crystals of the organic compound and additive into an aqueous solution of polyvinyl alcohol or other water-soluble polymeric substance that is commonly used as a binder for the heat-sensitive recording layer, and then stirring the resulting dispersion at a temperature lower than the melting points of the organic compound and additive. A coating solution for heat-sensitive recording layer containing such developer mixture is prepared and applied to a suitable base and drying, and the resulting heat-sensitive recording material has the same practical sensitivity as that of the heat-sensitive recording material prepared by using the fine particles of the above-described eutectic mixture of electron accepting organic compound and additive. A heat-sensitive recording material may be prepared as follows: particles of the urea derivative and/or urethane derivative (hereunder referred to as a melting point modifier) and the electron accepting organic compound are separately mixed with a binder, the two mixtures are blended with a solution containing other components such as a color former-containing paint solution, and the resulting coating solution for the heat-sensitive recording layer is applied to a suitable base, which is subsequently dried. The characteristics of the resulting heat-sensitive recording material with respect to the color forming temperature and the change in color density with the developing temperature are different from those of the heat-sensitive recording material using only the electron accepting organic compound as a developer. However, generally, a higher color density can be obtained by using the fine particles of the developer mixture (an intimate mixture of the electron accepting organic compound and melting point modifier). This fact shows that a color developer powder need not be prepared by a method wherein a complete melt or solution of the electron accepting organic compound and the melting point modifier is solidified and ground into fine particles, but that the desired color forming temperature and color density can be obtained by a developer powder wherein at least part of the modifier mixes and has intimate contact with the electron accepting organic compound. Therefore, a developer mixture capable of achieving the object of the present invention can be produced by any of the following methods:

(1) the melting point modifier and the electron accepting organic compound are melted with heat to form an intimate mixture which is then cooled to solidify and ground into particles;

(2) the melting point modifier and the electron accepting organic compound are dissolved in a suitable solvent, and the solvent is evaporated, or alternatively, the solution is transferred into a poor solvent to form a precipitate, and the resulting residue or precipitate is optionally dried and ground into particles of a developer mixture;

(3) the melting point modifier and the electron accepting organic compound, preferably in a fine particulate form, are added to a solution in a suitable solvent for forming a coating paint containing a conventional binder, and the mixture is stirred for a given period to form a coating solution for developer (the stirring temperature may be between room temperature and the lower of the melting points of the modifier and organic compound); and (4) the melting point modifier and the electron accepting organic compound are dissolved in a suitable common solvent, then dispersed in a solvent that does not dissolve the modifier or organic compound or their mixture (in the presence of a dispersant as required) to form a developer dispersion.

The third and fourth methods are particularly effective when the developer mixture resulting from a eutectic mixture or solution of the melting point modifier and electron accepting organic compound does not crystallize (i.e., remains a non-crystalline powder) at ordinary temperatures.

When the melting point modifier is a urea derivative or urethane derivative, and if a crystal made of a single eutectic mixture with the electron accepting organic compound is to be obtained, it sometimes occurs that the modifier must be used in a greater amount than the electron accepting organic compound. However, for practical purposes, the mixing ratio of the electron accepting organic compound (a developer in the narrow sense of the term) and the modifier need not be such that a single mixture crystal of the two is formed. A mixture of a great amount of the electron accepting organic compound and a small amount of the modifier can produce a product that exhibits satisfactory properties as a practical developer (developer in the broad sense of the term).

Any color former that is used in ordinary pressure-sensitive recording paper and heat-sensitive recording paper can be used in the present invention without particular limitation. Specific examples are (1) triarylmethane compounds such as 3,3-bis(p-dimethylaminophenyl)-6-dimethylaminophthalide (crystal violet lactone), 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3-(p-dimethylaminophenyl)-3-(2-phenylindole-3-yl)phthalide, 3,3-bis(1,2-dimethylindole-3-yl)-5-dimethylaminophthalide, 3,3-bis-(1,2-dimethylindole-3-yl)-dimethylaminophthalide, 3,3-bis-(9-ethylcarbazole-3-yl)-5-dimethylaminophthalide, 3,3-bis-(2-phenylindole-3-yl)-5-dimethylaminophthalide, and 3-p-dimethylaminophenyl-3-(1-methylpyrrole-2-yl)-dimethylaminophthalide; (2) diphenylmethane compounds such as 4,4'-bis-dimethylaminobenzyhydrylbenzyl ether, N-halophenylleucoauramine, and N-2,4-5-trichlorophenylleucoauramine; (3) xanthene compounds such as rhodamine B-anilinolactam, rhodamine B-p-nitroanilinolactam, rhodamine B-p-chloroanilinolactam, 6-diethylamino-2-dibenzylaminofluoran, 6-diethylamino-2-octylaminofluoran, 6-diethylamino-2-(3,4- dichloroanilino)fluoran, 6-diethylamino-2-(2-chloroanilino)fluoran, 6-diethylamino-3-methyl-2-anilinofluoran, 6-piperidino-3-methyl-2-anilinofluoran, 6-ethyl-tolylamino-3-methyl-2-anilinofluoran, 6-ethyl-tolylamino-3-methyl-2-phenetylfluoran, and 6-diethylamino-2-(4-nitroanilino)fluoran; (4) thiazine compounds such as benzoylleucomethylene blue, and p-nitrobenzoylleucomethylene blue; (5) spiro compounds such as 3-methyl-spiro-dinaphthopyran, 3-ethylspiro-dinaphthopyran, 3,3'-dichloro-spiro-dinaphthopyran, 3-benzylspiro-dinaphthopyran, 3-methylnaphtho-(3-methoxybenzo)-spiropyran and 3-propyl-spiro-dibenzopyran. These color formers may be used either singly or in combination, and the proper color former is determined by the specific use and the properties desired.

Preferred color developers for use in the present invention are phenolic derivatives and aromatic carboxylic acid derivatives, and bisphenols are particularly preferred. Specific examples include phenols such as p-octylphenol, p-tert-butylphenol, p-phenylphenol, 1,1-bis(p-hydroxyphenyl)propane, 2,2-bis(p-hydroxyphenyl)propane, 1,1-bis(p-hydroxyphenyl)pentane, 1,1-bis(p-hydroxyphenyl)hexane, 2,2-bis(p-hydroxyphenyl)hexane, 1,1-bis(p-hydroxyphenyl)-2-ethyl hexane, and 2,2-bis(4-hydroxy-3,5-dichlorophenyl)propane; aromatic carboxylic acid derivatives such as p-hydroxybenzoic acid, ethyl p-hydroxybenzoate, butyl p-hydroxybenzoate, 3,5-di-tert-butylsalicylic acid, 3,5-di-$\alpha$-methylbenzylsalicylic acid, and polyvalent metal salts of these carboxylic acids.

Other additives that can be used in the present invention include an oil-absorbing material, such as an inorganic pigment, that is dispersed in the binder to prevent the fouling of the recording head during service, as well as an aliphatic acid and metal soap that is added to increase the releasability of the recording material from the head. Therefore, according to the present invention, a heat-sensitive recording material can be prepared by applying to a base a coating solution that contains not only the color former and color developer that contribute directly to the color formation, but also a pigment, wax, and other additives. Specific examples include a pigment such as kaolin, calcined kaolin, talc, pyrophylite, diatomaceous earth, calcium carbonate, aluminum hydroxide, magnesium hydroxide, magnesium carbonate, titanium oxide, barium carbonate, urea-formalin filler, or cellulose filler; wax such as paraffin wax, carnauba wax, microcrystalline wax, polyethylene wax, and higher aliphatic esters. Suitable metal soaps are polyvalent metal salts of higher aliphatic acids such as zinc stearate, aluminum stearate, calcium stearate, and zinc oleate.

The color former, color developer, pigment, wax and other suitable additives are dispersed in a binder to make a coating solution for application onto a base. Water-soluble binders are generally used, and they include polyvinyl alcohol, hydroxyethyl cellulose, hydroxypropyl cellulose, ethylenemaleic anhydride copolymer, styrene-maleic anhydride copolymer, isobutylenemaleic anhydride copolymer, polyacrylic acid, polyacrylamide, starch derivative, casein and gelatin. To make these binder waterproof, a gelling agent or cross-linking agent, or a hydrophobic polymer emulsion, for example, styrene-butadiene rubber latex or acrylic resin emulsion, may be added.

The present invention is now described in greater detail by reference to the following examples, which are provided here for illustrative purposes, and are not intended to limit its scope.

EXAMPLE 1

Twenty grams of 6-piperidino-3-methyl-2-anilinofluoran was put into 100 g. of a 5% aqueous solution of polyvinyl alcohol (degree of polymerization: 500; saponification value: 99%) and the mixture was agitated in a ball mill for 10 hours to provide solution No. 1.

Fine particles (avg. size: 10$\mu$) of a hundred grams of 2,2-bis(p-hydroxyphenyl)propane and an equal amount of 1-phenyl-3-dodecylureide were put into 500 g of a 5% aqueous solution of polyvinyl alcohol, and the mixture was stirred in a ball mill for 24 hours to provide solution No. 2.

The solutions Nos. 1 and 2 were mixed, and to the mixture, 250 g of calcined kaolin and 400 g of a 10% aqueous solution of polyvinyl alcohol were added, and the resulting mixture was agitated in a ball mill for 5 hours. The coating solution thus obtained was applied onto a paper base (basis weight: 50 g/m$^2$) and dried to provide a heat-sensitive recording paper with a heat-sensitive recording layer having a dry weight of 6 g/m$^2$.

COMPARATIVE EXAMPLE 1

Twenty grams of 6-piperidino-3-methyl-2-anilinofluoran was put into 100 g of 5% polyvinyl alcohol, and the mixture was agitated in a ball mill for 10 hours to produce solution No. 1'.

Fine particles of a hundred grams of 2,2-bis(p-hydroxyphenyl)propane and an equal amount of stearic acid amide were put into 500 g of a 5% aqueous solution of polyvinyl alcohol, and the mixture was agitated in a ball mill for 24 hours to provide solution No. 2'.

The solutions Nos. 1' and 2' were mixed, to the mixture, 250 g of calcined kaolin and 400 g of a 10% aqueous solution of polyvinyl alcohol were added, and the resulting mixture was agitated in a ball mill for 5 hours. The coating solution thus obtained was applied to a paper base (basis weight: 50 g/m$^2$) and dried to provide a heat-sensitive recording paper with a heat-sensitive recording layer having a dry weight of 6 g/m$^2$.

Figure 2:
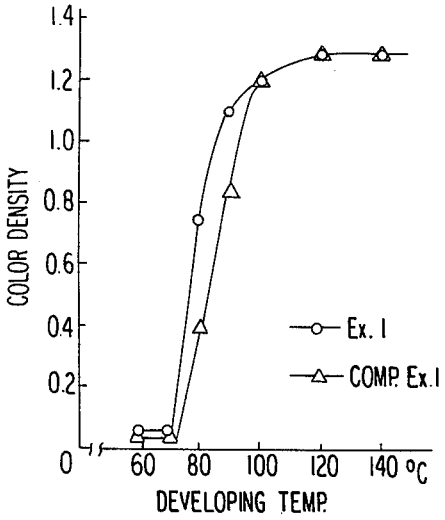

The relation between the developing temperature and color density obtained with the heat-sensitive recording papers of Example 1 and Comparative Example 1 is shown in FIG. 2 and Table 1 below.

TABLE 1

| Color Density | Developing Temperature 60° | 70° | 80° | 90° | 100° | 120° | 140° |
|---|---|---|---|---|---|---|---|
| Example 1 | 0.05 | 0.05 | 0.75 | 1.10 | 1.20 | 1.30 | 1.30 |
| Comp. Example 1 | 0.04 | 0.04 | 0.40 | 0.90 | 1.20 | 1.30 | 1.30 |

The samples were developed with a flat plate impression test developer wherein the flat plate heated to the temperatures indicated in Table 1 was pressed against the samples for a period of one second. The color density was measured with a Macbeth RD-100 R densitometer. The samples of Example 1 and Comparative Example 1 had almost the same gamma value, but the first sharp increase in color density that occurred in the sample of Example 1 was at about 10° C. lower than in the case of the sample of Comparative Example 1, showing that the former was more sensitive than the latter.

EXAMPLE 2

Twenty grams of 6-piperidino-3-methyl-2-anilinofluoran was put into 100 g of 5% polyvinyl alcohol, and the mixture was stirred for 10 hours in a ball mill to provide solution No. 1.

Fine particles of 100 g of 2,2-bis(p-hydroxyphenyl)-propane, 80 g of stearic acid amide and 10 g of 1-(p-methoxyphenyl)-3-butyl ureide were added to 500 g of a 5% aqueous polyvinyl alcohol solution, and the mixture was stirred for 24 hours in a ball mill to provide solution No. 2.

Solution No. 3 was prepared as in the preparation of Solution No. 2 except that the fine particles of 1-(p-methoxyphenyl)-3-butylureide were used in an amount of 20 g.

To Solution Nos. 1 and 2, 250 g of calcined kaolin and 400 g of a 10% aqueous solution of polyvinyl alcohol were added, and the mixture was stirred in a ball mill to provide solution No. 4. In a like manner, solution No. 5 was prepared from Solutions Nos. 1 and 3.

The resulting two coating solutions Nos. 4 and 5 were applied to paper bases (basis weight: 50 g/m$^2$) and dried to provide two heat-sensitive recording papers (Samples Nos. 2-1 and 2-2) each with a heat-sensitive recording layer having a dry weight of 6 g/m$^2$.

Figure 3:
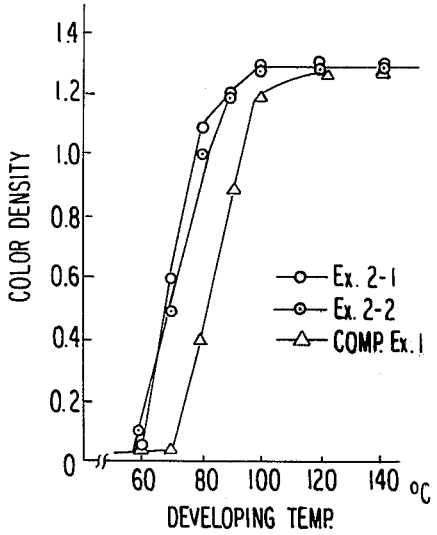

The relation between the developing temperature and color density of Samples Nos. 2-1 and 2-2 as compared with the sample of Comparative Example 1 is shown in FIG. 3 and Table 2 below. The development and measurement of color density were conducted as in Example 1.

TABLE 2

| Color Density | Developing Temperature 60° | 70° | 80° | 90° | 100° | 120° | 140° |
|---|---|---|---|---|---|---|---|
| Example 2-1 | 0.05 | 0.60 | 1.10 | 1.20 | 1.30 | 1.30 | 1.30 |
| Example 2-2 | 0.10 | 0.50 | 1.00 | 1.20 | 1.30 | 1.30 | 1.30 |
| Comparative Example 1 | 0.04 | 0.04 | 0.40 | 0.90 | 1.20 | 1.30 | 1.30 |

The results of Table 2 as described above is depicted to in FIG. 3. From the result that the initial color-forming temperature of Examples 2-1 and 2-2 were lowered by 10° C. than that of Comparative Example 1, it can be seen that the former was more sensitive than the letter.

EXAMPLE 3

Thirty grams of 6-diethylamino-3-chloro-2-benzylaminofluoran was put into 100 g of 5% polyvinyl alcohol (degree of polymerization: 500; saponification value: 99%), and the mixture was stirred in a ball mill for 16 hours to provide solution No. 1.

Fine particles of 100 g of 2,2-bis(p-hydroxyphenyl)-propane and an equal amount of phenylcarbamoyloxydodecane were put into 500 g of a 5% aqueous solution of polyvinyl alcohol, and the mixture was stirred in a ball mill for 24 hours to provide solution No. 2.

Solutions Nos. 1 and 2 were mixed, and to the mixture, 250 g of calcined kaolin and 400 g of a 10% aqueous solution of polyvinyl alcohol were added, and the resulting mixture was stirred in a ball mill again for 5 hours. The resulting coating solution was applied to a paper base (basis weight: 50 g/m$^2$) and dried to provide a heat-sensitive recording paper with a heat-sensitive recording layer having a dry weight of 6 g/m$^2$.

COMPARATIVE EXAMPLE 2

Ninety grams of 6-diethylamino-3-chloro-2-benzylaminofluoran was put into 100 g of a 5% aqueous solution of polyvinyl alcohol, and the mixture was stirred in a ball mill for 16 hours to provide solution No. 1'.

Fine particles of 100 g of 2,2-bis(p-hydroxyphenyl)-propane and an equal amount of stearic acid amide were put into 500 g of a 5% aqueous solution of polyvinyl alcohol, and the mixture was stirred in a ball mill for 24 hours to provide solution No. 2'.

Solutions Nos. 1' and 2' were mixed, and to the resulting mixture, 250 g of calcined kaolin and 400 g of a 10% aqueous solution of polyvinyl alcohol were added, and the mixture was stirred in a ball mill again for 5 hours.

The coating solution so obtained was applied to a paper base (basis weight: 50 g/m$^2$) and dried to provide a control heat-sensitive recording paper.

Figure 4:
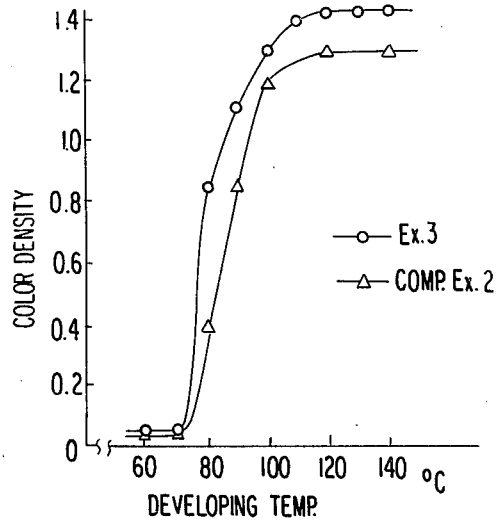

The relation between the developing temperature and color density of the samples of Example 3 and Comparative Example 2 is shown in Table 3 and FIG. 4. The method of development and measurement of color density was as in Example 1 and Comparative Example 1.

TABLE 3

| Color Density | Developing Temperature 60° | 70° | 80° | 90° | 100° | 120° | 140° |
|---|---|---|---|---|---|---|---|
| Example 3 | 0.05 | 0.06 | 0.84 | 1.10 | 1.30 | 1.42 | 1.42 |
| Comp. Example 2 | 0.04 | 0.04 | 0.40 | 0.85 | 1.20 | 1.30 | 1.30 |

From the result of Table 3, it can be seen that the color density obtained in Example 3 was higher than that obtained in Comparative Example 2 at the same temperature higher than the initial color-forming temperature.

EXAMPLE 4

Thirty grams of 6-diethylamino-3-chloro-2-benzylaminofluoran was added to 100 g of a 5% aqueous solution of polyvinyl alcohol, and the mixture was stirred in a ball mill for 16 hours to provide solution No. 1.

A hundred grams of 2,2-bis(p-hydroxyphenyl)propane and an equal amount of 2,4-bis(dodecyloxycarbonylamino) toluene:

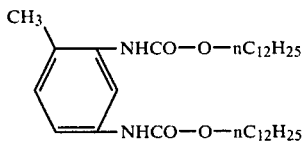

were melted at 170° C. to form an intimate mixture which was then cooled into a transparent solid form. The solid product was ground into fine particles under cooling with ice (upon standing for an adequately long period, the same solid product turned gradually into a crystalline form having a melting point around 80° C.). The fine particles were put into 500 g of a 5% aqueous solution of polyvinyl alcohol, and the mixture was stirred in a ball mill for 8 hours to provide solution No. 2.

Figure 5:
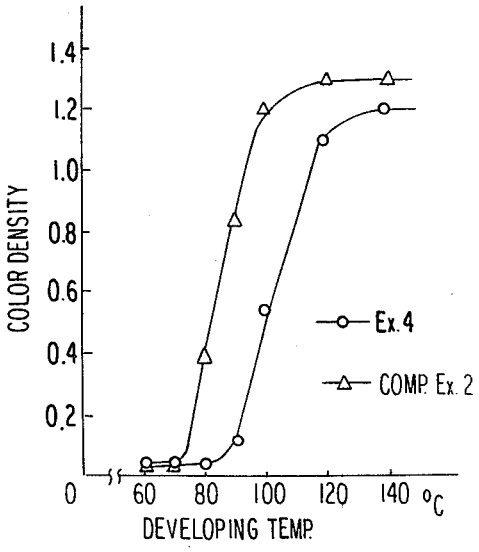

The solution Nos. 1 and 2 were mixed, and to the resulting mixture, 250 g of calcined kaolin and 400 g of a 10% aqueous solution of polyvinyl alcohol were added, and the mixture was stirred again in a ball mill for 5 hours. The coating solution thus obtained was applied onto a paper base (basis weight: 50 g/m$^2$) and dried to provide a heat-sensitive recording paper with a heat-sensitive recording layer having a dry weight of 6 g/m$^2$. The relation between the developing temperature and color density of the recording paper as compared with that of the sample of Comparative Example 2 is shown in Table 4 and FIG. 5.

TABLE 4

| Color Density | Developing Temperature 60° | 70° | 80° | 90° | 100° | 120° | 140° |
|---|---|---|---|---|---|---|---|
| Example 4 | 0.04 | 0.04 | 0.04 | 0.12 | 0.54 | 1.10 | 1.20 |
| Comp. Example 2 | 0.04 | 0.04 | 0.04 | 0.85 | 1.20 | 1.30 | 1.30 |

The first sharp increase in color density that occurred in the sample of Example 4 was at about 15° C. higher that in the case of the sample of Comparative Example 2, showing that the initial color-forming temperature can be freely changed in wide range by the addition of the compound of this invention.

While the invention has been described in detail and with reference to specific embodiment thereof, it will be apparent to one skilled in the art that various changes and modifications can be made therein without departing from the spirit and scope thereof.

What is claimed is:

1. A heat-sensitive recording material comprising a base and one or more heat-sensitive color-forming layers provided on said base, wherein said color-forming layers contain an electron donating colorless dye and an electron accepting organic compound, and further wherein at least one of said color-forming layers contains either (a) a urea compound having at least 7 carbon atoms represented by formula (I)

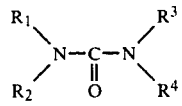

(I)

wherein $R^1$, $R^2$, $R^3$, $R^4$ each represents a hydrogen atom or a substituted or unsubstituted alkyl or aryl group; $R^4$ may also represent the group represented by formula (Ia)

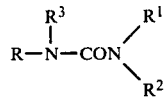

(Ia)

wherein R is an alkylene, allylene, aralkylene, or oxyalkylene group; $R^1$, $R^2$ and $R^3$ have the same meaning as defined above; and the sum of the carbon atoms of the substituents represented by $R^1$, $R^2$, $R^3$, and $R^4$ in formula (I) is at least 6, or (b) a urethane compound having at least 8 carbon atoms represented by formula (II), (III), or (IV)

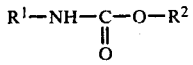

(II)

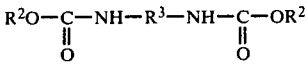

(III)

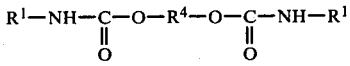

(IV)

wherein $R^1$ is a substituted or unsubstituted alkyl group or aryl group; $R^2$ is a substituted or unsubstituted alkyl group; $R^3$ is an alkylene, allylene, aralkylene, or oxyalkylene group; and $R^4$ is an alkylene or oxyalkylene group.

2. A heat-sensitive recording material according to claim 1 wherein the electron accepting organic compound is a compound having a carboxyl or a phenolic hydroxy group.

* * * * *